United States Patent [19]

Kim

[11] Patent Number: 4,767,001

[45] Date of Patent: Aug. 30, 1988

[54] GOLF BAG

[76] Inventor: Young S. Kim, 22573 Woodridge Ct., Cupertino, Calif. 95014

[21] Appl. No.: 17,904

[22] Filed: Feb. 24, 1987

Related U.S. Application Data

[63] Continuation-in-part of Ser. No. 866,477, Jun. 9, 1986, abandoned.

[51] Int. Cl.[4] ..... A63B 55/00

[52] U.S. Cl. ..... 206/315.3; 206/315.7; 206/315.8; 206/315.4; 248/96; 280/DIG. 6; D3/37

[58] Field of Search ..... 206/315.2–315.8; 248/96; 211/70.2; 273/32 E; D3/37

[56] References Cited

U.S. PATENT DOCUMENTS

| | | | |
|---|---|---|---|
| 1,924,183 | 8/1933 | Fritz | 248/96 |
| 3,172,681 | 3/1965 | Moses | 211/70.2 X |
| 3,471,162 | 10/1969 | Meiklejohn | 280/DIG. 6 |
| 3,746,204 | 7/1973 | Nagai | 220/469 X |
| 3,941,398 | 3/1976 | Nelson | 206/315.4 X |
| 3,953,045 | 4/1976 | Feret, Jr. | 206/315.6 X |
| 4,319,616 | 3/1982 | Light | 206/315.6 X |
| 4,340,102 | 7/1982 | Isabel | 206/315.6 |
| 4,383,563 | 5/1983 | Kirchhoff, Jr. | 206/315.2 |
| 4,442,937 | 4/1984 | DeLauder | 206/315.4 |
| 4,522,299 | 6/1985 | Clark et al. | 206/315.7 X |
| 4,538,728 | 9/1985 | Lewis | 206/315.3 |

FOREIGN PATENT DOCUMENTS

| | | | |
|---|---|---|---|
| 2134797 | 8/1984 | United Kingdom | 206/315.3 |

*Primary Examiner*—William Price

*Attorney, Agent, or Firm*—Flehr, Hohbach, Test, Albritton & Herbert

[57] ABSTRACT

A golf bag (10) has a generally cylindrical lower portion (12) and a generally cylindrical, rigid upper portion (100). The rigid upper portion (100) has first and second halves (102, 104) vertically hinged (106, 108) along a side and latch means (116, 118) on an opposite side of the first and second halves from the vertically hinged side. A bottom end of the upper portion is configured to extend over a top end of the lower portion. There are a set of at least one mating projection (110) and at least one recess (82) between the bottom end of the upper portion and the top end of the lower portion. The mating at least one projection and recess fixedly attach the rigid upper portion in place on the lower portion when the latching means are closed to fasten the opposite side of the first and second halves together. The rigid, generally cylindrical body (12) is formed from first and second sections (13, 52) vertically hinged (162, 172) along a first side. A latch means (44, 72) is provided on an opposite, second side of the first and second sections (13, 52). The first section has a middle portion (18, 20), an upper portion (15) and a lower portion (22). The upper and lower portions extend laterally beyond a third side of the middle portion (18, 20) to form a generally C-shaped configuration. The second section (52) and the third side are configured to fit together between the upper and lower portions (14, 22) when the second section is closed against the first section.

17 Claims, 5 Drawing Sheets

GOLF BAG

ORIGIN OF THE APPLICATION

This application is a continuation-in-part of my earlier filed U.S. application Ser. No. 06/866,477, filed June 9, 1986, now abandoned.

BACKGROUND OF THE INVENTION

1. Field of the Invention

This invention relates to an improved form of a protective golf bag which prevents damage to golf clubs carried in the bag when the golf clubs are transported. More particularly, it relates to construction of such a protective golf bag which increases the degree of protection afforded to the golf clubs and increases the functionality of the golf bag.

2. Description of the Prior Art

A variety of modifications have been proposed to conventional golf bags in order to provide increased protection for the golf clubs and to make the bag more useful. For example, U.S. Pat. No. 4,522,299, issued June 11, 1985 to Clark et al. discloses a rigid golf bag having a releasable rigid cover which encloses the heads of the golf clubs for transporting the clubs in the bag. Other examples of modifications to conventional golf bags are disclosed in the following issued U.S. patents: U.S. Pat. No. 1,924,183, issued Aug. 29, 1933 to Fritz; U.S. Pat. No. 2,590,178, issued Mar. 25, 1952 to Jamison; U.S. Pat. No. 2,760,782, issued Aug. 28, 1956 to Hartzell; U.S. Pat. No. 2,837,346, issued June 3, 1958 to Chambless; U.S. Pat. No. 3,165,330, issued Jan. 12, 1965 to Cotton; U.S. 3,172,681, issued Mar. 9, 1965 to Moses; U.S. Pat. No. 3,471,162, issued Oct. 7, 1969 to Meiklejohn; U.S. Pat. No. 3,738,677, issued June 12, 1973 to Renock; U.S. Pat. No. 3,746,204, issued July 17, 1973 to Nagai; U.S. Pat. No. 3,941,398, issued Mar. 2, 1976 to Nelson; U.S. Pat. No. 4,012,051, issued Mar. 15, 1977 to Embinder; U.S. Pat. No. 4,017,091, issued Apr. 12, 1977 to Wallen; U.S. Pat. No. 4,053,169, issued Oct. 11, 1977 to Taylor; U.S. Pat. No. 4,078,594, issued Mar. 14, 1978 to Oecki; U.S. Pat. No. 4,319,616, issued Mar. 16, 1982 to Light; U.S. Pat. No. 4,340,102, issued July 20, 1982 to Isabel; U.S. Pat. No. 4,383,563, issued May 17, 1983 to Kirchoff, Jr.; U.S. Pat. No. 4,442,937, issued Apr. 17, 1984 to Delauder; U.S. Pat. No. 4,538,728, issued Sept. 3, 1985 to Lewis; Des. 177,799, issued May 29, 1956 to De Orlow; Des. 272,285, issued Jan. 17, 1984 to Gillett and Des. 273,905, issued May 15, 1984 to Rosen. Other modifications are disclosed in Canadian patent 671,291, issued Oct. 1, 1963 to Meiklejohn and Benham, U.K. Patent Application 2,134,797, published Aug. 22, 1984. While a large number of such modifications to conventional golf bags have been disclosed in the prior art, a need still remains for a golf bag that will provide adequate protection for golf clubs while they are being transported, which is stylish in design and capable of carrying all of the articles a golfer will typically need for a round of golf.

SUMMARY OF THE INVENTION

Accordingly, it is an object of this invention to provide a novel golf bag that will protect golf clubs while they are being transported and which will carry all of the articles a golfer will typically need for a round of golf in a size comparable to a conventional golf bag.

It is another object of the invention to provide such a golf bag which is fabricated from a minimum number of parts.

It is a further object of the invention to provide such a golf bag which has a construction which permits the parts of the golf bag to be provided in a stylish design.

The attainment of these and related objects may be achieved through use of the novel golf bag herein disclosed. In one aspect of the invention, a golf bag in accordance with the invention has a generally cylindrical lower portion and a generally cylindrical, rigid upper portion. The rigid upper portion has first and second halves vertically hinged along a side and latch means on an opposite side of the first and second halves from the vertically hinged side. A bottom end of the upper portion is configured to extend over a top end of the lower portion. There are a set of at least one mating projection and at least one recess between the bottom end of the upper portion and the top end of the lower portion. The mating at least one projection and recess fixedly attach the rigid upper portion in place on the lower portion when the latching means are closed to fasten the opposite side of the first and second halves together.

In another aspect of the invention, a golf bag has a rigid, generally cylindrical body formed from first and second sections vertically hinged along a first side. A latch means is provided on an opposite, second side of the first and second sections. The first section has a middle portion, an upper portion and a lower portion. The upper and lower portions extend laterally beyond a third side of the middle portion to form a generally C-shaped configuration. The second section and the third side are configured to fit together with the second section between the upper and lower portions when the second section is closed against the first section.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
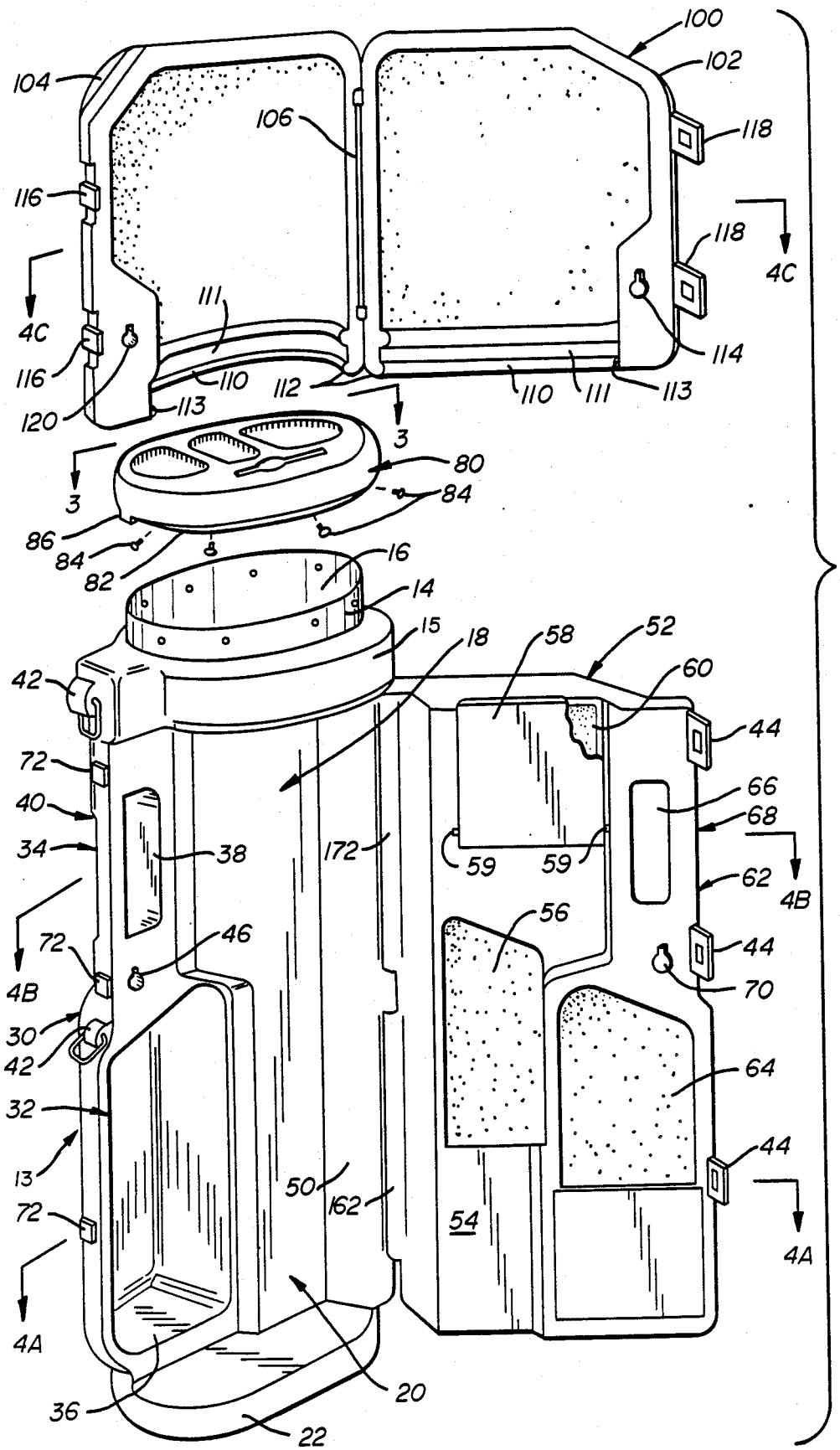
FIG. 1 is a partially exploded perspective view of a golf club bag in accordance with the present invention.
Figure 2:
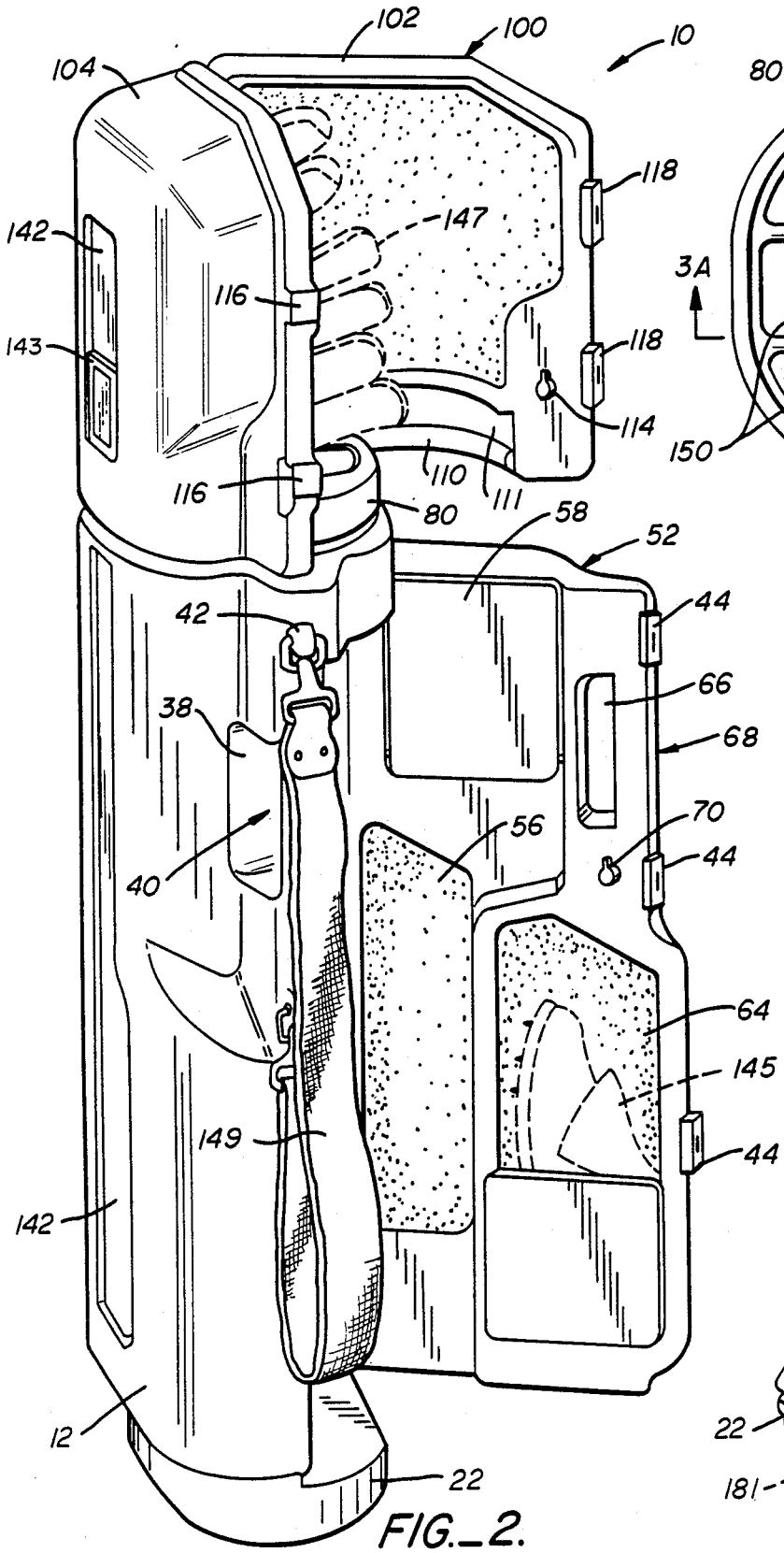
FIG. 2 is a perspective view of the golf bag of FIG. 1.

FIGS. 1 and 2 show a golf club bag according to the present invention and referred to by the general reference number 10. The bag 10 has a cylindrically-shaped container 12. Container 12 has a flange 14 located about a large upper opening 16. The inner cross-sectional area of the container 12 increases from an upper section 18 to a lower section 20. A base member 22 is integrally connected to the lower section 20 and is perpendicular to the longitudinal dimension of container 12. The upper and lower sections 18 and 20 form a middle portion of the container 12 between an upper portion 15 and a lower portion formed by the base 22.

A side member 30 is integrally connected to container 12 and base member 22. Side member 30 extends perpendicular to the side of container 12 and is positioned along the longitudinal dimension of container 12. Side member 30 has a wide compartment section 32 opposite lower section 20 and a handle section 34 of narrower width opposite upper section 18. Compartment section 32 has a large compartment recess 36. Handle section 34 has a slot aperture 38 which defines a right handle section 40. Side member 30 has two D-ring supports 42 and three snap-type latches 72 along its outer edge. A lock aperture 46 is located midway along side member 30.

A door support member 50 is integrally formed from container 12 and extends along the longitudinal dimension of container 12. A door member 52 is attached to door support 50 by integrally formed hinges 162 and 172. Door 52 is shaped to fit into the recess defined by container 12, side member 30, base member 22 and door support 50. Door 52 has an inner section 54 which is shaped to fit against container 12. Inner section 54 has an lower inner recess 56. Inner recess 56 has a door 58 hinged at 59 over an upper inner recess 60.

Door 52 has an outer section 62 which is shaped to fit against side member 30. Outer section 62 has an outer recess 64 which corresponds to and faces compartment recess 36 of side member 30. Outer section 62 has a slot aperture 66 which defines a left handle section 68. Left handle section 68 corresponds to right handle section 40 of side member 30.

Outer section 62 also has a locking mechanism 70 which extends through the door 52. Locking mechanism 70 corresponds to lock aperture 46 on side member 30. Door 52 has three latch tabs 44 located on its outer edge which correspond to latches 72 on side member 30.

A collar member 80 is shaped to mate with flange 14 and cover opening 16. Collar 80 has recessed areas 82 spaced around the outer perimeter of collar 80. Collar 80 has anti-rotation lugs 86 located at opposing sides of collar 80 which form a divider between the areas 82. A rivet 84 is passed through the collar 80 at four equally spaced perimeter locations in each recess 82 and through flange 14 to secure the collar 80 to the container 12.

A cover 100 has a left side 102 and a right side 104 which are attached to each other by hinge 106. Hinge 106 is integrally formed from cover 100. Cover 100 is generally cylindrical in shape when left and right sides 102 and 104 are closed together. Cover 100 has a double walled construction (see also FIG. 4C). Cover 100 has tab members 110 extending inwardly from the bottom edge of cover 100. The tabs 110 are shaped to mate with the collar recesses 82. Cover 100 has a recessed portion 111 which contains the tabs 110 and is shaped to fit around collar 80. Cover 100 has recessed portions 112 and 113 which correspond to antirotation lugs 86 on collar 80.

Left cover side 102 has a locking mechanism 114 which extends through right cover side 104. Two tab members 118 are located along the edge of left cover side 102. Right cover side 104 has two snap latches 116 located along its edge which correspond to tabs 118 of left cover side 102. A locking aperture 120 is located in right cover side 104 to correspond to locking mechanism 114.

FIG. 2 shows the device 10 in assembled form. When door 52 is closed, it fits snugly against container 12, side member 30, base member 22 and door support 50. The left and right handle sections 68 and 40 form an integral handle 140. Latches 72 are secured to tabs 44. Locking mechanism 70 locks into place in lock aperture 46. Cover 100 closes around collar 80. Latches 116 are secured to tabs 118. Locking mechanism 114 is locked into aperture 120.

Container 12, door 52, and cover 100 have two recessed slots 142 (see also FIGS. 4A–4C) which run longitudinally along opposite sides of bag 10. These slots 142 provide structural support and help prevent the bag from sagging. A holder 143 for identification is provided in one of the slots 142, as shown in FIG. 2.

In use, the compartment 64 holds a golf shoe 145 (FIG. 2). The other shoe (not shown) fits in the facing compartment 36. Compartment 56 holds a towel, windbreaker and/or similar articles. Compartment 60 holds extra golf balls, golf tees and similar small articles. With cover 100, in place over golf clubs 147 inserted in the container 12, the golf clubs are protected against damage while they are being transported, even as checked baggage on an airline, for example. When the user arrives at a destination, the cover 100 is removed, and the container 12 is used to carry the clubs 147 and other equipment while playing golf in the same manner as a conventional golf bag. Strap 149 aids in carrying the container 12 in the usual manner.

Figure 3:
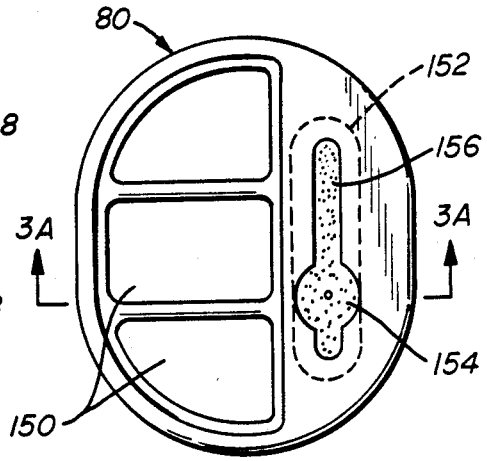
FIG. 3 is a top elevational view of a collar section.
Figure 3A:
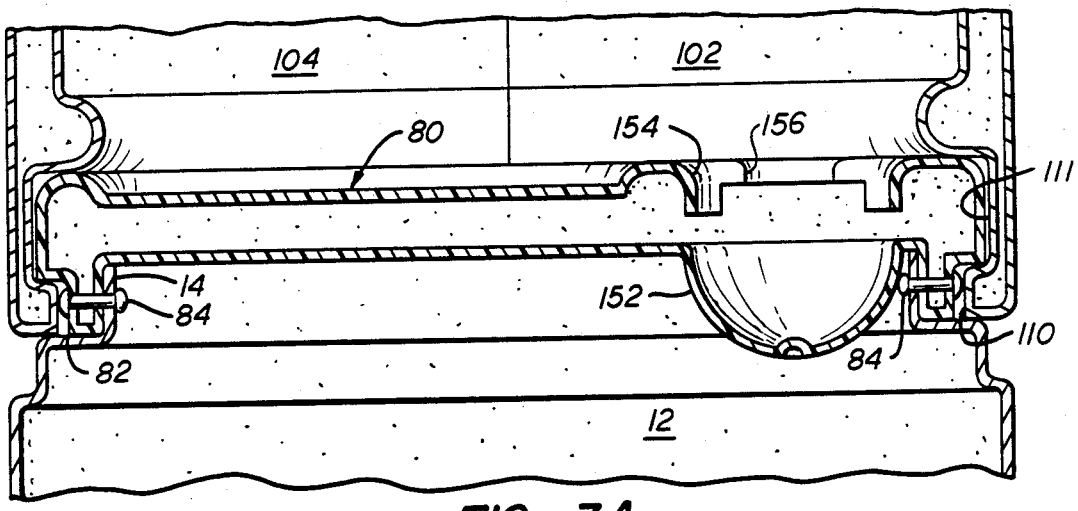
FIG. 3A is a cross-sectional view of the golf bag taken along the line 3A—3A in FIG. 3.

FIG. 3 shows a top elevational view of collar section 80, also shown in cross-section in FIG. 3A. Collar 80 has three openings 150 which extend through the collar 80. A section of collar 80 is double walled and forms a golf ball chamber 152. Chamber 152 is shaped to hold three or more golf balls in a straight line parallel to the top of collar 80. The top portion of chamber 152 has a golf ball opening 154 which is large enough to allow the passage of golf balls into and out of the chamber. The top portion of chamber 152 also has a finger slot 156 which runs the length of the chamber. Chamber 152 is lined with a high friction fabric, or provides for interference fit between the chamber and ball perimeter which prevents the golf balls from moving after they are placed in chamber 152. FIG. 3A also shows how the tab members 110 and recessed portion 111 of the cover 102 interact with the collar section 80 and the recesses 82 to attach the cover 102 to the container 12.

Figure 4A:
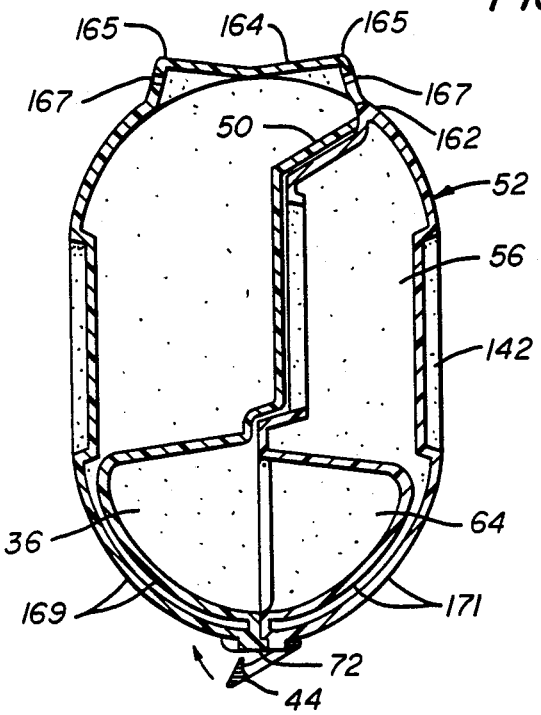
FIG. 4A is a cross-sectional view of the golf bag taken along line 4A—4A in FIG. 1.
Figure 4B:
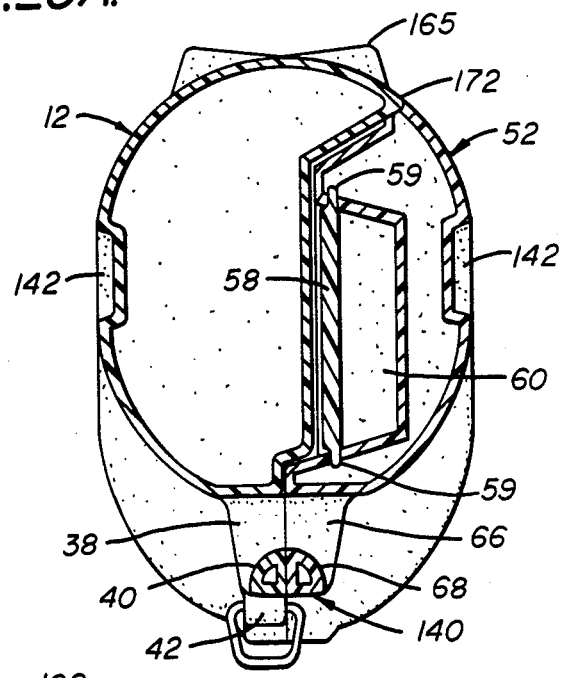
FIG. 4B is a cross-sectional view of the golf bag taken along line 4B—4B in FIG. 1.
Figure 4C:
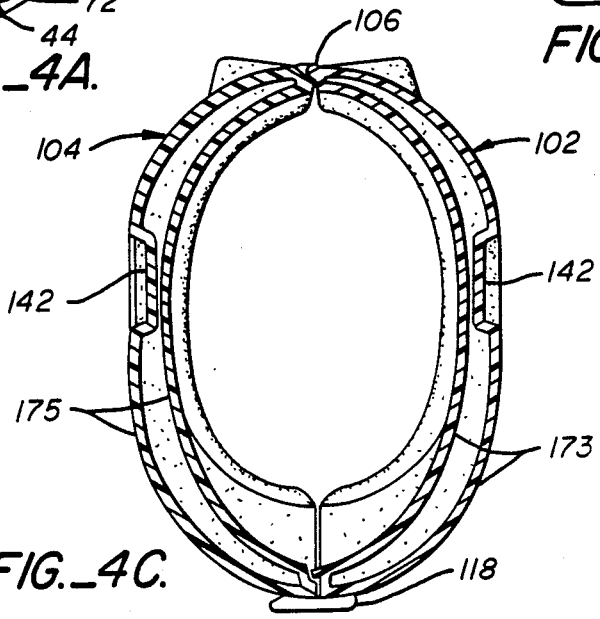
FIG. 4C is a cross-sectional view of the golf bag taken along line 4C—4C in FIG. 1.

FIGS. 4A, 4B and 4C illustrate a cross-sectional views of bag 10 taken along lines 4A—4A, 4B—4B and 4C–4C of FIG. 1. A first hinge 162 connects door 52 and door support 50. Hinge 162 is integrally formed from door 52 and door support 50. Container 12 has a back support section 164 which is located on the opposite side from handle 140. Back support section 164 has projections 165 and runs longitudinally along container 12 to provide support when bag 10 is set horizontally on the ground. Holes 167 through the section 164 receive a strap (not shown) to provide one way for attaching the bag 10 to a golf cart. Additional holes 167 are provided through the section 164 near its top.

FIG. 4A shows how the container 12 and the door 52 are molded in one piece. Double walls 169 and 171 at the compartments 36 and 64 provide additional strength for the bag 10 at those locations and are produced by the molded construction of the container 12 and the door 52.

Further aspects of the construction of the container 12 and the door 52 are shown in FIGS. 4B and 4C. The integral handle 140 is shown formed from the left half 40 and the right half 68, respectively integral parts of the container 12 and the door 52. The double walls 173 and 175 of the right and left halves 102 and 104 of the cover 100 provide extra protection for the heads of the golf clubs 147 (FIG. 2) above the container 12, so that the clubs 147 will not be damaged when the bag 100 is shipped.

Figure 5:
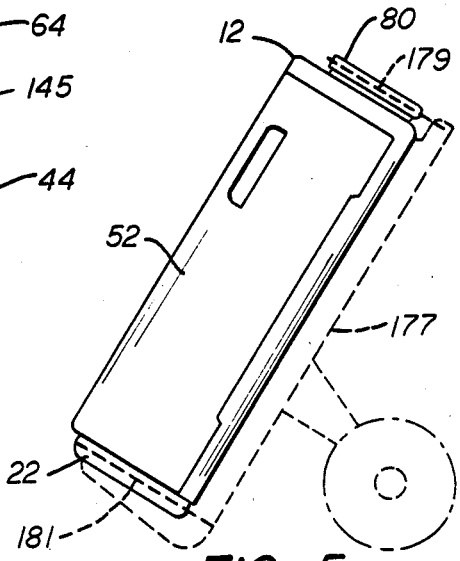
FIG. 5 is a side elevational view of the golf bag of FIGS. 1-4C in use.

The operation of the golf bag 10 can be further understood by referring to FIGS. 1, 3 and 5. Golf clubs are placed shaft end first into container 12 through the openings 150 of collar section 80. The club heads will extend above the collar 80. The openings 150 in collar 80 allow the clubs to be evenly distributed in container 12 and prevent them from shifting from side-to-side. Golf equipment such as extra clothing, shoes 145 or gloves may be placed in the recesses 64, 36 or 56 or 58 where they are readily accessible. The door 52 is then closed, latched and locked. Golf balls are placed in ball chamber 152. When the bag 10 is in use, the cover 100 is left off, and the golfer has access to clubs and balls from the top collar section 80. The bag 10 can be carried by handle 140 or by strap 149. As shown in FIG. 5, door 52 terminates short of the top collar section 80 and the base section 22. When the container 12 is attached to a cart 177 by straps 179 and 181 at the collar section 80 and the base section 22, the straps 179 and 181 do not interfere with opening door 52.

When the golf bag 10 is not in use, cover 100 is closed about the top of collar 80. The cover tabs 110 and recess 111 mate with collar 80. The cover 100 is then closed, latched and locked. The club heads are now fully enclosed and protected. The double walled construction of the cover 100 insures that the club heads will not be damaged, even if the bag is dropped.

The bag 10 is rigid in construction. A high density polyethylene is used for the double walled cover 100 and collar 80. This rigid material holds its shape and prevents damage to the club heads. The container 12, side member 30, base member 22, door support 50 and door 52 are made of a high density and low density polyethylene copolymer. This polyethylene copolymer, while still fairly rigid, allows for a little flexibility. This flexibility provides the golfer with some comfort when the golfer is carrying the bag by the handle 140 or the strap 149.

Figure 6:
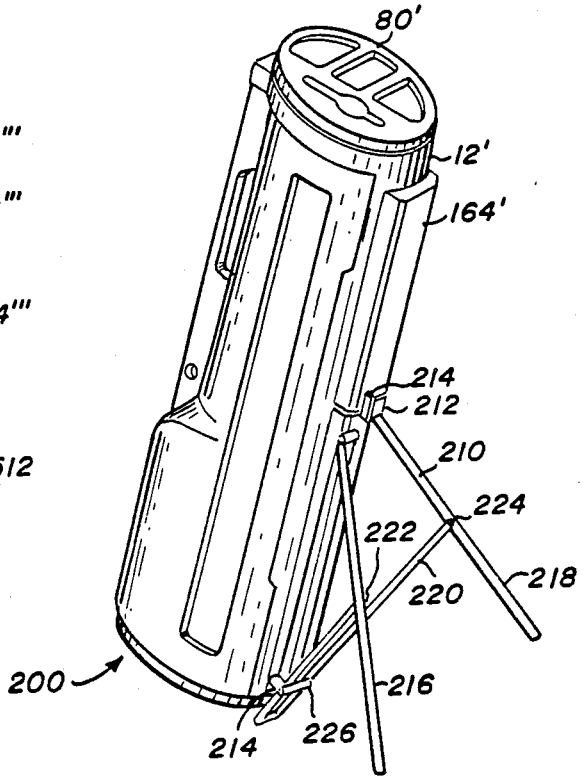
FIG. 6 is a perspective view of an alternative embodiment of the golf bag of the present invention with a stand.

FIG. 6 shows a perspective view of an alternative embodiment of the present invention and is referred to by the general reference number 200. Elements of invention 200 which are similar to elements of invention 10 are designated by a prime number.

Bag 200 has removable folding stand 210. Stand 210 has a support plate 212. Back support section 164' is provided with a recess into which support plate 212 is fitted. Two latches 214 are located along the top and bottom edges of support plate 212 and correspond to latch tabs located on back support 164'. Latches 214 hold support plate 212 in the recessed area of 164'.

First and second leg members 216 and 218, respectively, are pivotally mounted to support plate 212. A flexible strut 220 is generally V-shaped with one end pivotally mounted to first leg 216 at point 222 and the other end pivotally mounted to second leg 218 at point 224. A strut support 226 is attached to support plate 212. The strut support 226 is generally U-shaped. The lower portion of strut 220 is passed through strut support 226. Other than as shown and described, the construction and operation of the FIGS. 6–8 embodiment, including container 12' and rigid collar 80', is the same as the FIGS. 1–5 embodiment.

Figure 7:
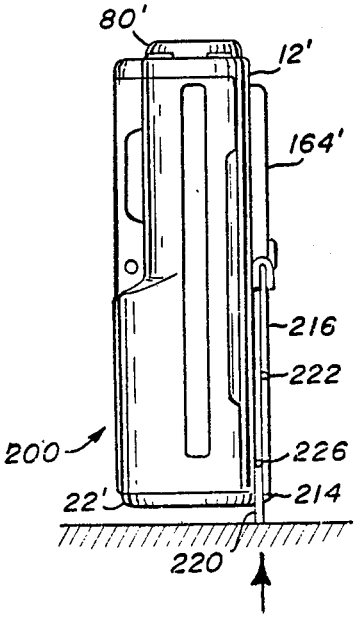
FIG. 7 is a side elevational view of the golf bag of FIG. 6 with the stand in the folded position.
Figure 8:
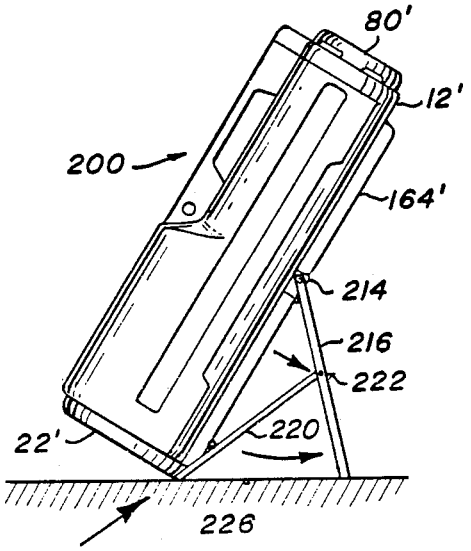
FIG. 8 is a side elevational view of the golf bag of FIG. 6 with the stand in the open position.

FIGS. 7 and 8 show a side elevational view of bag 200 with the stand 210. FIG. 7 shows the stand 210 in a folded position. To operate the stand, the bag 200 is set down on the lower portion of strut 220. Strut 220 is pushed upward relative to the bag by the weight of the bag 200. Strut 220 slides through strut support 226 and is flexed outward. The strut 220 pushes first and second legs 216 and 218 outward into the open position as shown in FIG. 8. The bag 200 is now positioned in a stable upright position. If the golfer does not desire to use stand 210, the stand 210 can be easily removed by unlatching the latches 214.

Figure 9:
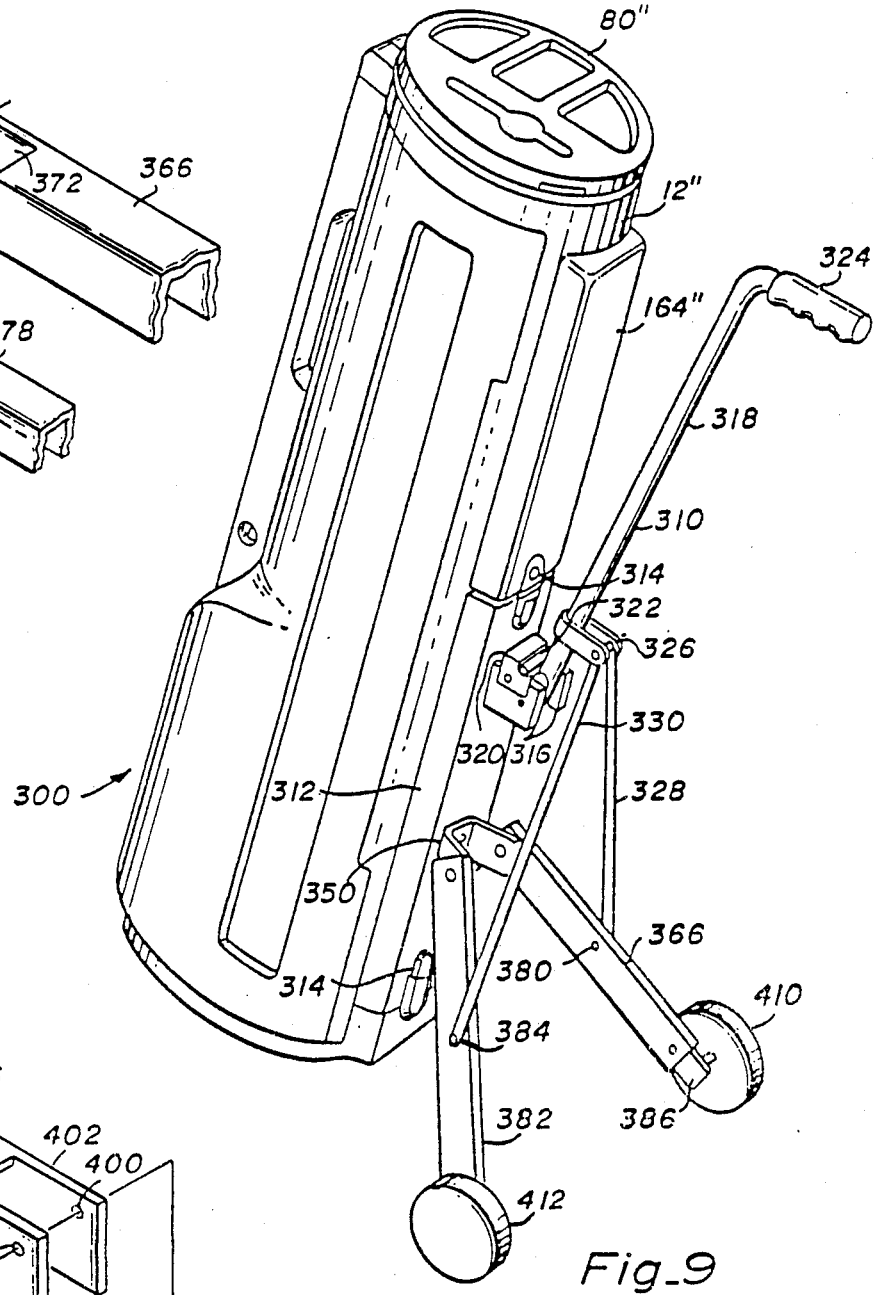
FIG. 9 is a perspective view of an alternative embodiment of the golf bag with a cart.

FIG. 9 shows a perspective view of an alternative embodiment of the present invention and is referred to by the general reference number 300. Elements of embodiment 300 which are similar to elements of embodiment 10 are designated by a double prime number.

Bag 300 has a removable folding cart 310. Cart 310 has a support plate 312. Back support 164'' is provided with a recessed portion into which support plate 312 is fitted. Two latches 314 are located on the upper and lower edges of support plate 312 and correspond to latch tabs located on back support 164''. The latches 314 hold the support plate 312 into the recessed portion of back support 164''.

Support plate 312 has two handle support members 316 which are attached and extend perpendicular to support plate 312. A tubular handle 318 is pivotally mounted between handle supports 316 and can swing in an upward and downward direction. A hook latch 320 is pivotally mounted to handle supports 316. Latch 320 is spring loaded. Handle 318 has a latch tab 322 which fits into the hook of latch 320. The spring loaded latch 320 holds the tab 322 in place and thereby locks the handle 318 in the up position.

Handle 318 is provided with a plastic hand grip 324. A U-shaped strut support 326 is attached to handle 318 above the handle supports 316. First and second support members 328 and 330, respectively, are pivotally mounted to strut support 326.

A V-shaped leg support 350 is attached to support plate 312. The end sections of the leg support 350 extend at an angle of approximately sixty degrees to the surface of plate support 312.

Figure 10:
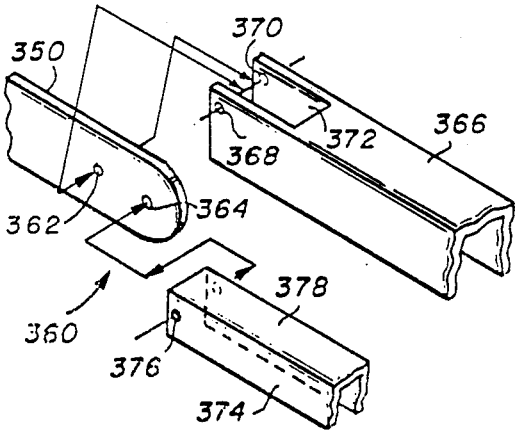
FIG. 10 is an exploded view of a portion of the cart of FIG. 9.

FIG. 10 shows an exploded view of the leg support 350 and is designated by the general reference number 360. Support 350 has a first and second aperture 362 and 364, respectively. A first leg support 366 is a U-shaped beam which has two apertures 368 and 370. Leg support 366 is pivotally mounted about support 350 at apertures 362, 368 and 370. Leg support 366 has a gap 372 to allow for clearance of the support 350. A first articulation leg strut 374 is a U-shaped beam which has apertures 376 and 378. Articulation strut 374 is pivotally mounted to the side of support 350 at apertures 364, 378 and 376. The width of articulation strut 374 is such that it fits inside of leg support 366 when both are attached to support 350.

Referring now to FIG. 9, first strut 328 is pivotally mounted to first leg support 366 at point 380. Second strut 330 is pivotally mounted to a second leg support 382 at a point 384. Second leg support 382 also has a second articulation strut which is not shown in FIG. 9. First leg support 366 is attached to an axle member 386.

Figure 11:
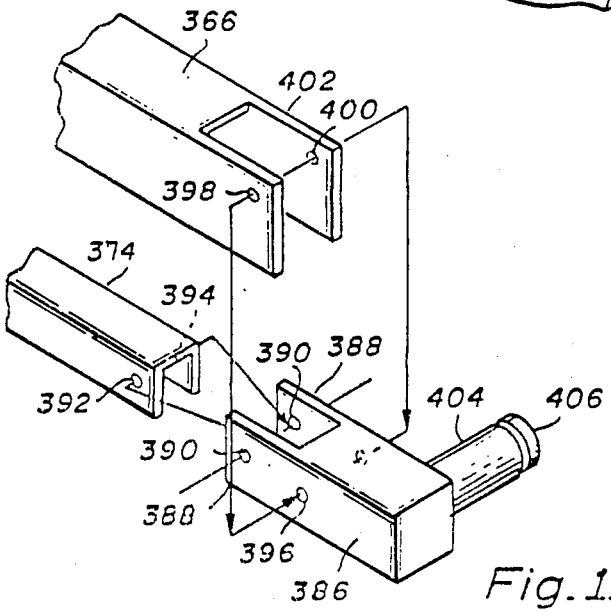
FIG. 11 is an exploded view of a portion of the cart of FIG. 9.

FIG. 11 shows an exploded view of the attachment of first leg support 366, first articulation strut 374, and axle member 386. Axle member 386 has two tab members 388. Each tab member has an aperture 390. First articulation strut 374 has two apertures 392 and 394. First articulation strut 374 is pivotally mounted between tab members 388 at apertures 390, 392, and 394.

Axle member 386 has another aperture 396 which passes all the way through axle member 386. First leg support 366 has two apertures 398 and 400. First strut support 366 is pivotally mounted over axle member 386 at apertures 396, 398 and 400. Leg support 366 has a gap 402 which allows for clearance of axle member 386.

An axle 404 is integrally formed to axle member 386 and extends from its side. The axle 404 has a retaining end tab 406 which securely holds a plastic tire in place about axle 404.

Referring again to FIG. 9, a plastic tire 410 is attached to axle member 386. Second leg support 382 has a similar axle member, not shown, which in turn is attached to a tire 412.

To operate the cart 310, the golfer pulls up on handle 318. As the handle 318 is pulled up, struts 328 and 330 pull leg supports 382 and 366 upward and outward. When the handle is locked into the up position by latch 320, the legs and wheels are fully extended. The cart can now be used by pulling the handle 318.

If the golfer decides not to use the cart, latches 314 can be unlocked and the cart is easily removed from the recess in the back support 164″. The support plate 312 for the cart 310 and the support plate 212 for the stand 210 are shaped the same so that the stand 210 and the cart 310 are interchangeable. Other than as shown and described, the construction and operation of the FIGS. 9–11 embodiment, including the container 12″ and rigid collar 80″, is the same as in the FIGS. 6–8 embodiment.

Figure 12:
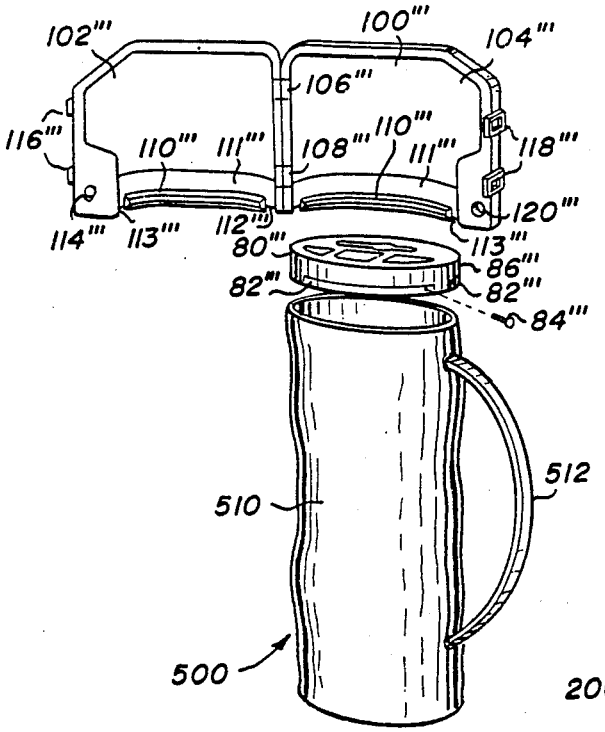
FIG. 12 is a perspective view of an alternative embodiment of the golf bag of the present invention.

FIG. 12 shows an alternative embodiment of the present invention and is referred to by the general reference number 500. Corresponding to those of the golf bag 10 of FIGS. 1 and 2 are designated by a triple prime number.

Golf bag 500 has a rigid collar 80‴ and cover 100‴ which operate in the same way as the collar 80 and cover 100 of golf bag 10. Golf bag 500, however, has a flexible cylindrically-shaped container 510. Container 510 can be made of leather, canvas, or any other strong flexible material. The container 510 is riveted to collar 80‴ by a plurality of rivets 84‴ which are equally spaced about the perimeter of collar 80‴. Container 510 also has a flexible carrying strap 512 attached to it.

Golf bag 500 has the advantage of being light weight due to the flexible container 510. At the same time, the golf club heads are protected by rigid collar 80‴ and cover 100‴. The rigid collar 80‴ and cover 100‴ are identical in configuration to the collar 80 and cover 100 in the FIGS. 1–5 embodiment, and the reader is referred to the description of those elements in the description of that embodiment for an understanding of the corresponding portions of those elements in the FIG. 12 embodiment.

It should now be readily apparent to those skilled in the art that a novel golf bag capable of achieving the stated objects of the invention has been provided. The golf bag of this invention will protect golf clubs while they are being transported and will hold all of the articles typically needed for a round of golf in a bag which is comparable in size to a conventional golf bag. The golf bag is fabricated from a minimum number of parts, and its construction allows it to be stylish in design.

It should further be apparent to those skilled in the art that various changes in form and details of the invention as shown and described may be made. It is intended that such changes be included within the spirit and scope of the claims appended hereto.

What is claimed is:

1. A golf bag comprising a generally cylindrical lower portion and a generally cylindrical, rigid upper portion, said rigid upper portion comprising first and second halves vertically hinged along a side, latch means on an opposite side of said first and second halves from the vertically hinged side, a bottom end of said upper portion being configured to extend over a top end of said lower portion, there being a set of at least one mating projection and at least one recess between the bottom end of said upper portion and the top end of said lower portion, said mating at least one projection and recess fixedly attaching said rigid upper portion in place on said lower portion when said latching means are closed to fasten the opposite side of said first and second halves together.

2. The golf bag of claim 1 in which there is at least one mating projection on said first and second halves at the bottom end of said upper portion and said at least one recess is on the top end of said lower portion.

3. The golf bag of claim 2 in which said at least one mating projection and said at least one recess are generally arcuate shaped.

4. The golf bag of claim 1 in which said lower portion is rigid.

5. The golf bag of claim 1 in which said lower portion is flexible.

6. The golf bag of claim 1 in which said first and second halves each have double walls.

7. The golf bag of claim 6 in which said first and second halves are formed from a polyethylene.

8. The golf bag of claim 7 in which the polyethylene is a copolymer of a high density polyethylene and a low density polyethylene.

9. A golf bag comprising a rigid, generally cylindrical body formed from first and second sections vertically hinged along a first side, latch means on an opposite, second side of said first and second sections, said first section having a middle portion, an upper portion and a lower portion, said upper and lower portions extending laterally beyond a third side of said middle portion to form a generally C-shaped configuration, said second section and said third side being configured to fit together with said second section between said upper and lower portions when said second section is closed against said first section.

10. The golf bag of claim 9 in which said first and second sections each have a mating half of a handle for carrying said golf bag extending along the second side of said first and second sections, said mating halves forming said handle when said second section is closed against said first section.

11. The golf bag of claim 9 further comprising a generally cylindrical, rigid upper portion, said rigid upper portion comprising first and second halves vertically hinged along a side, latch means on an opposite side of said first and second halves from the vertically hinged side, a bottom end of said upper portion being configured to extend over a top end of said rigid body, there being a set of at least one mating projection and at least one recess between the bottom end of said upper portion and the top end of said rigid body, said mating at least one projection and recess fixedly attaching said rigid upper portion in place on said rigid body when said latching means are closed to fasten the opposite side of said first and second halves together.

12. The golf bag of claim 11 in which there is at least one mating projection on said first and second halves at the bottom end of said upper portion and said at least one recess is on the top end of said rigid body.

13. The golf bag of claim 12 in which said at least one mating projection and said at least one recess are generally arcuate shaped.

14. The golf bag of claim 11 in which said first and second halves each have double walls.

15. The golf bag of claim 14 in which said first and second halves are formed from a polyethylene.

16. The golf bag of claim 15 in which the polyethylene is a copolymer of a high density polyethylene and a low density polyethylene.

17. The golf bag of claim 11 is which said second section has a surface facing the third side of said first section, the surface of said second section and the third side each being configured to form facing storage compartments by having an indentation toward an outer surface of said first and second sections, the storage compartment configurations and outer surface of said first and second sections forming a double wall construction at the storage compartments.

* * * * *